US007789764B2

(12) United States Patent
Wilson et al.

(10) Patent No.: US 7,789,764 B2
(45) Date of Patent: Sep. 7, 2010

(54) GOLF CLUB TRAINING DEVICE

(75) Inventors: Todd Wilson, Burlington, NY (US); David Rocheleau, Lexington, SC (US)

(73) Assignee: TW Golf LLC, Burlington, NJ (US)

( * ) Notice: Subject to any disclaimer, the term of this patent is extended or adjusted under 35 U.S.C. 154(b) by 0 days.

(21) Appl. No.: 12/315,550

(22) Filed: Dec. 4, 2008

(65) Prior Publication Data

US 2009/0181784 A1 Jul. 16, 2009

Related U.S. Application Data

(60) Provisional application No. 61/005,353, filed on Dec. 4, 2007.

(51) Int. Cl.
*A63B 69/36* (2006.01)

(52) U.S. Cl. ..... 473/220; 473/242; 473/251; 473/253; 473/254

(58) Field of Classification Search ..... 473/219–256
See application file for complete search history.

(56) References Cited

U.S. PATENT DOCUMENTS

| | | | | |
|---|---|---|---|---|
| 3,319,962 | A * | 5/1967 | Summers | 473/251 |
| 3,909,004 | A * | 9/1975 | Vella | 473/241 |
| 4,136,877 | A | 1/1979 | Antonious | |
| 4,461,482 | A | 7/1984 | Bojicic | |
| 4,530,505 | A | 7/1985 | Stuff | |
| 4,902,014 | A * | 2/1990 | Bontomase et al. | 473/241 |
| 4,928,971 | A | 5/1990 | Soles, Jr. | |
| 4,962,931 | A | 10/1990 | Jazdzyk, Jr. | |
| 5,351,963 | A | 10/1994 | Baek | |
| 5,388,832 | A | 2/1995 | Hsu | |
| 5,429,366 | A | 7/1995 | McCabe | |
| 5,709,609 | A | 1/1998 | Carney | |
| 6,066,052 | A | 5/2000 | Li | |
| 6,371,864 | B1 | 4/2002 | Norwood | |
| 7,052,409 | B2 | 5/2006 | Goldsmith | |
| 7,112,151 | B2 | 9/2006 | Adams | |
| 7,118,488 | B2 | 10/2006 | Chan et al. | |
| 7,186,185 | B2 | 3/2007 | Nagy | |
| 7,226,362 | B1 | 6/2007 | Schell et al. | |
| 7,611,419 | B2 * | 11/2009 | O'Neill | 473/242 |

* cited by examiner

*Primary Examiner*—Nini Legesse
(74) *Attorney, Agent, or Firm*—McDonald Hopkins LLC

(57) ABSTRACT

The present invention provides an apparatus for a golf club and training device. The golf club may be approved for on the course play by the United States Golf Association (USGA). An embodiment of a training device for a golf club includes a handle having a grip where the handle is coupled to a golf club head. The head has an internal alignment device and may include a contact plate, a top plate and a bottom plate. The top plate has a first upper surface including a top alignment marking and the bottom plate has a second upper surface including a bottom alignment marking. The top plate may include an attachment aperture for attaching an external alignment device. The external alignment device may include a laser, an alignment guide, a weight, or the like.

20 Claims, 12 Drawing Sheets

GOLF CLUB TRAINING DEVICE

CROSS-REFERENCE TO RELATED APPLICATIONS

This application claims benefit from U.S. Provisional Patent Application No. 61/005,353, entitled "Golf Club Training Device," filed on Dec. 4, 2007, which is hereby incorporated in its entirety by reference.

FIELD OF THE INVENTION

The present invention is generally related to golf club equipment, and more particularly, to golf club training devices.

BACKGROUND OF THE INVENTION

There have been many golf-training devices developed over the years for improving a golfer's game. Particularly when putting, it is desirable to accurately control the alignment of the clubface and the direction of movement of the club head at the point of impact. In addition, since the putting stroke is normally used on each golf hole played, it is especially desirable to consistently control the putting stroke. Forty three percent (43%) of all golf shots, on average, are hit with the putter. To strike a ball successfully, a golfer must take extreme care to contact the ball with a consistent stroke in order to deliver maximum power and control to the path of the ball.

In addition, there are a variety of golf club training devices that have been developed to assist the golfer in aligning the golfer's feet and club head as well as devices to help groove the proper swing path. One category of such devices includes those with one or two guide rails placed adjacent to the golf ball. The golfer can stroke the golf club along the guide rails to practice a straight-back and straight-through putting stroke. Unfortunately, the guide rails are typically not adjustable or removable. In addition, many known devices, or putters, have sight lines to assist the golfer in aiming the putter. However, these devices do not consistently ensure that the golfer's eye position is directly over the ball, in relation to the club head, and in parallel alignment to the target line. Another category of devices utilize one or more light sources emitting light from various locations on a golf club, such as the handle grip, to assist a golfer in determining the position of the club during the swing.

Yet other devices that assist the golfer in the alignment of the club head have included light sources associated with the golf club indicating the direction in which the clubface is pointed. One drawback of such known devices is that the golfer cannot use the golfer's own personal putter without modification. These devices require a modification or awkward attachment to the golfer's own putter. Such devices do not accommodate the golfer's desire to practice and play with the same putter, particularly their own putter, in an unmodified fashion.

In general, most golfers become comfortable with their own putter and less likely to use or feel comfortable with a putter if modified to change the appearance, shape, and/or weight distribution. In addition, most of these modified putters are not approved for on the course play by the United States Golf Association (USGA).

The prior art does not provide for a golf training device with removable and interchangeable components, including, but not limited to, light source inserts, protruding guide inserts, weighted inserts, and the like. Therefore, there is a need in the art to provide a golf club with the capability to point to a direction where the golfer is aiming, such as by incorporating an insert with a light source (e.g., a laser), so that the golfer will have a clear path of where the golf ball will travel. It is also desirable to incorporate inserts to assist the golfer in further improving the golfer's ability to hit the sweet spot. Lastly, it is further desirable that these inserts be removable so that the golfer can easily return to using his or her club without the benefit of any insert. The present invention fulfills this need. It is easy to use, provides immediate feedback, can be customized for feel, and can be used on the golf course.

DESCRIPTION OF THE DRAWINGS

Operation of the invention may be better understood by reference to the following detailed description taken in connection with the following illustrations, wherein.

SUMMARY OF THE INVENTION

Figure 1:
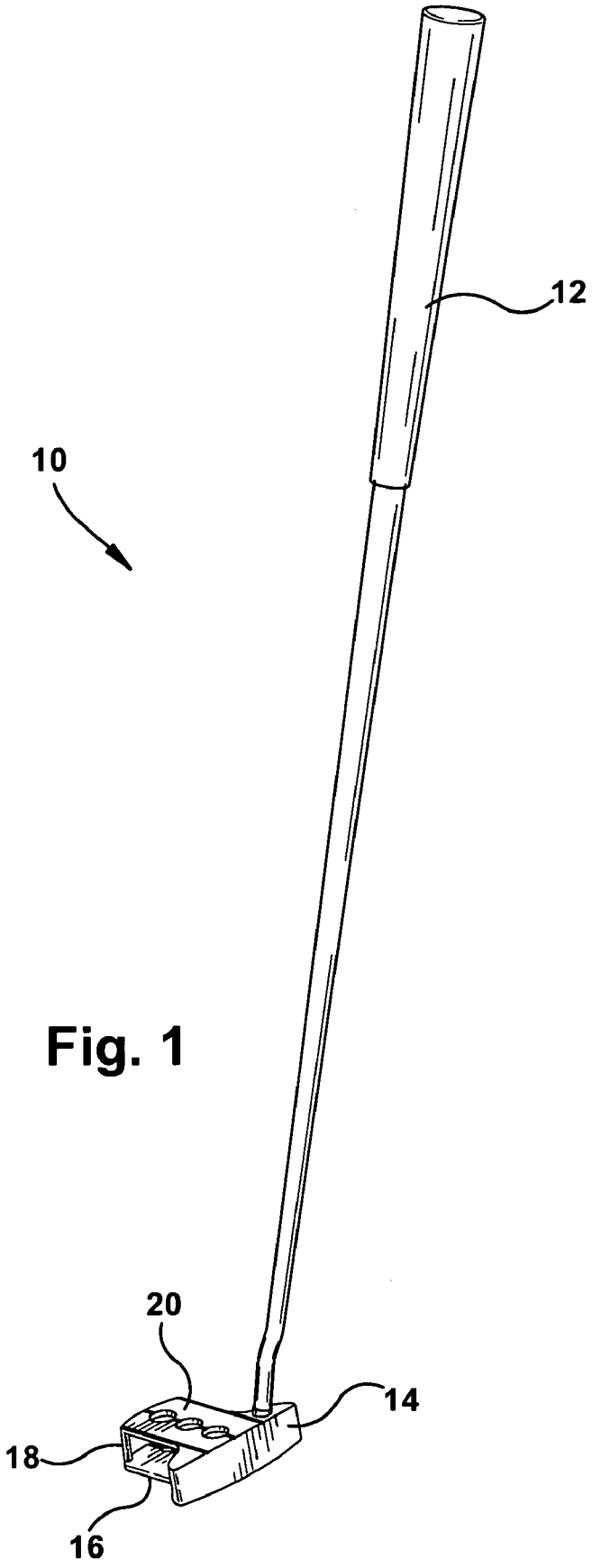
FIG. 1 illustrates a perspective view of an embodiment of the golf club training device.

A golf club having an internal and external alignment device. The golf club may include a handle having a grip at a first end and a head at a second end and a head having an internal alignment device. The head may include a contact plate, a top plate and a bottom plate. The top plate may extend rearwardly from the contact plate, where the top plate has a first upper surface. The first upper surface may include a top alignment marking located along said the upper surface. The bottom plate may extend rearwardly from the contact plate and be located beneath the top plate. The bottom plate may have a second upper surface, where the second upper surface may include a bottom alignment marking. The bottom alignment marking may be located along the second upper surface. The top plate may also include at least one attachment aperture. An external alignment device may be capable of engaging the attachment aperture.

DETAILED DESCRIPTION

While the invention is described herein with reference to several embodiments, it should be clear that the invention should not be limited only to the embodiments disclosed or discussed. The description of the embodiments herein is illustrative of the invention and should not limit the scope of the invention as described or claimed.

As generally described herein, the present invention provides a golf club 10, such as a putter for example, that may serve as a training aid and also as a USGA approved putter for on the course play. The putter 10 may provide a visual indication of the golfer's eye position in relation to the putter and the target line. The putter 10 may provide a visual indication of the desired target path as well as providing visual feedback to the golfer of the accuracy of the golfer's stroke immediately after that stroke. The putter 10 may assist golfers of all skill levels to properly direct a golf ball in a desired path by utilizing the putters 10 3-D multi-dimensional sighting system.

As can be seen in FIGS. 1-4, the putter 10 may include a handle 12, a clubface 14, a bottom portion 16, a rear portion 18, and a top portion 20. The bottom portion 16 of the club 10 may include at least one marking 30 that may act as a visual aid. The bottom portion 16 may also have a bottom mid-line 17. The bottom mid-line 17 may be located on the bottom portion 16 of the club 10 and extend from the club face 14 to the rear portion 18. The bottom mid-line 17 may be located in the approximate center of the bottom portion 16 and may extend through the center of each marking 30*a*, 30*b*, 30*c*. The bottom mid-line 17 may also be substantially parallel to each side of the bottom portion 16 and the lines 22, 24. The bottom mid-line 17 may be of any appropriate or desired color, but is preferably white. The marking 30 may be of any appropriate shape, but is preferably of a circular shape. The marking 30 may also be of any appropriate or desired color, but is preferably a white color. In an alternative embodiment, the putter 10 may not have any markings 30 at all on the bottom portion 16, but may instead have apertures that pass through the entire bottom portion 16 whereby the golfer may see the ground below.

Figure 2:
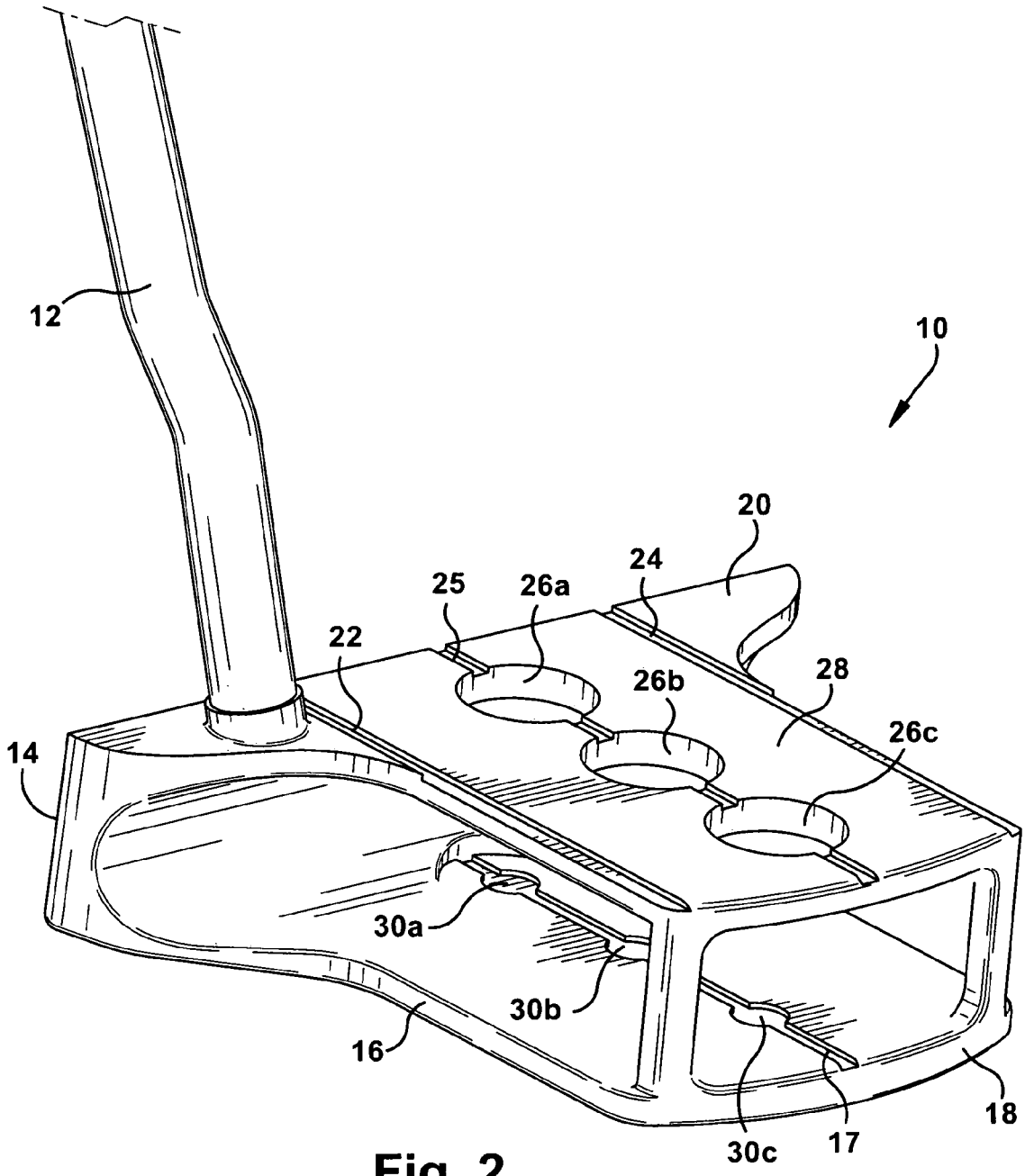
FIG. 2 illustrates a close up perspective view of the golf club training device.
Figure 3:
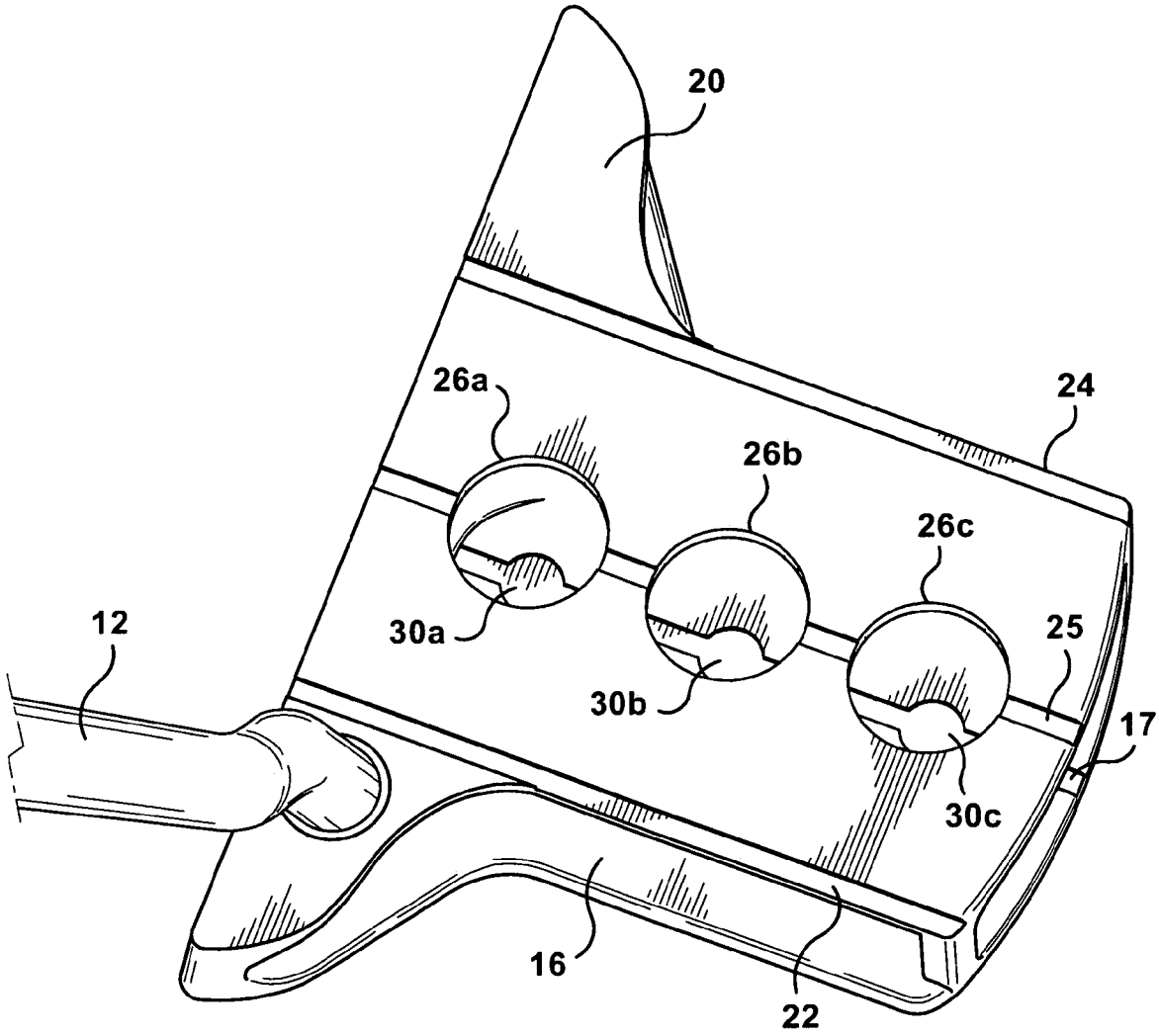
FIG. 3 illustrates another close up perspective view of the golf club training device.
Figure 4:
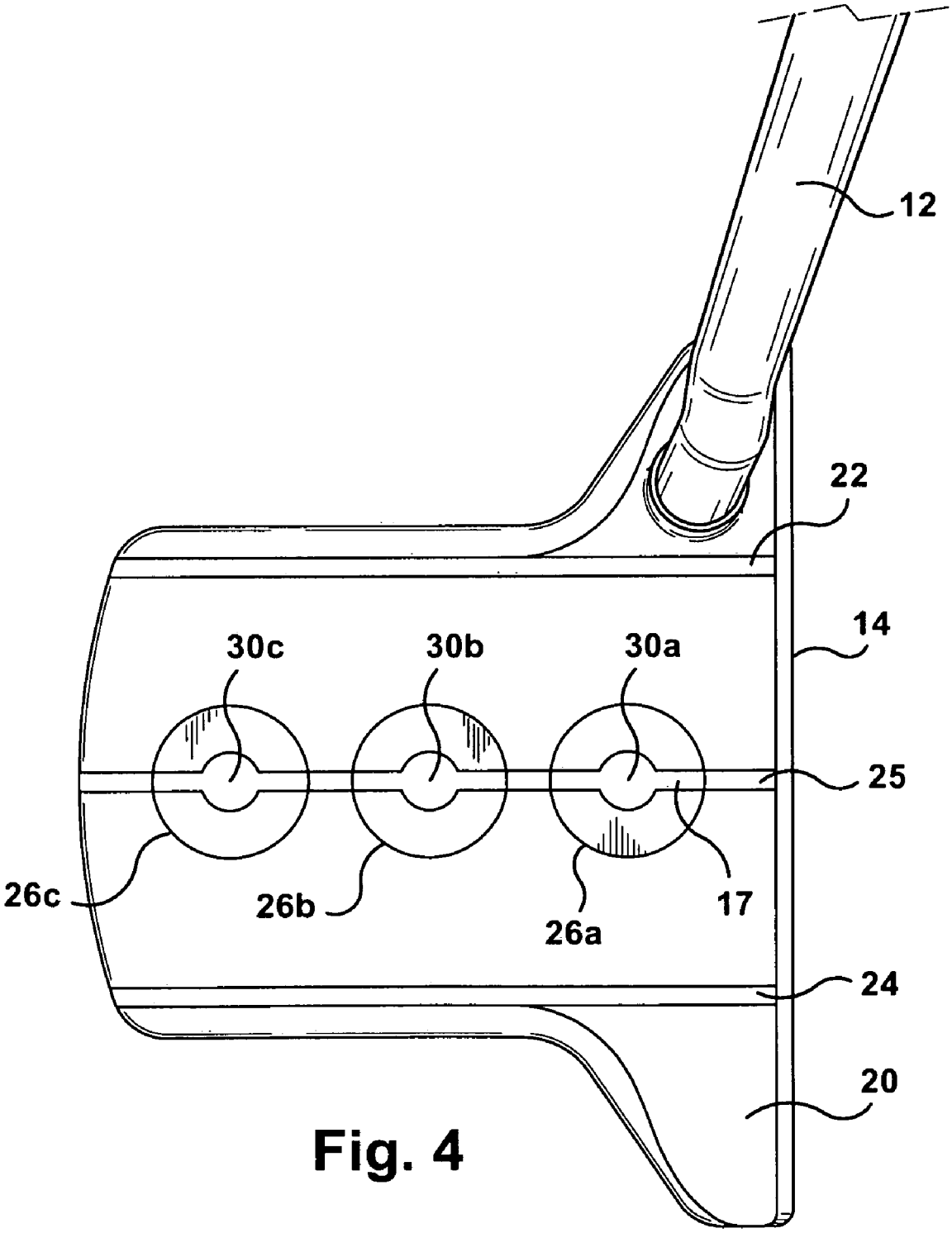
FIG. 4 illustrates a close up top view of the golf club training device.

With further reference to FIGS. 1-4, the top portion 20 may include two lines 22, 24, at least one aperture 26, and a bridge 28. The first line 22 and second line 24 may be located on the top portion 20 and extend along the edges of the bridge 28. The lines 22, 24 may be substantially parallel to one another and may be located substantially perpendicular to the clubface 14. The top portion 20 may also have a mid-line 25. The mid-line 25 may be located on the top portion 20 of the club 10 and extend from the club face 14 to the rear portion 18. The mid-line 25 may be located in the approximate center of the top portion 20 and may extend through the center of each aperture 26*a*, 26*b*, 26*c*. The mid-line 25 may also be substantially parallel to each side of the top portion 20 and the lines 22, 24. The mid-line 25 may be of any appropriate or desired color, but is preferably white. The lines 22, 24 may be of any appropriate or desired color, but are preferably white. The bridge portion 28 may be approximately perpendicular to the clubface 14 and may extend from where the top portion 20 meets the clubface 14 towards the rear portion 18 of the putter 10, thereby forming a large opening beneath the bridge 28 and above the bottom portion 16. The rear portion 18 of the putter 10 may be of a solid one piece design, or may be open in the middle as shown in FIG. 2. As another alternative, there may not even be a rear portion 18 so that the entire back end of the club 10 is completely open.

The apertures 26 of the top portion 20 may extend through the bridge 28. The apertures 26 may be of any appropriate shape and size, but are preferably of a substantially circular shape and of a size that allows enough room for three apertures 26*a*, 26*b*, 26*c*, as illustrated in FIGS. 1-4.

With additional reference to FIGS. 1-4, the number and size of apertures 26 is meant to correspond to the number and size of markings 30. The use of the apertures 26 located in the top portion 20 and the markings 30 located on the bottom portion 16 together may provide an alignment system. In order to line up the apertures 26 with the markings 30 underneath, the golfer's eyes must be directly over the top portion 20 of the club 10 and the ball. This insures that the golfers eyes are parallel to the target line. This putter 10 allows for a consistent set up and perfect alignment every time.

The visual alignment of the markings 30*a*, 30*b*, 30*c* and apertures 26*a*, 26*b*, 26*c* allows the golfer to determine whether or not his eyes are directly over the ball. This alignment is an aid to help align the golfer's eyes to the aim line on a consistent basis. The golfer will be able to see when the apertures 26 are not directly aligned with the markings 30 when the golfer looks at the top portion 20 of the putter 10, thereby allowing the golfer to achieve consistent head and eye position over the golf ball. If the golfer sees anything other than the white markings 30 located, preferably equidistantly, within the apertures 26, the golfer will know that his or her eye position is not above the aim line. This alignment system provides the golfer with a visual tool to more consistently get his eyes over the aim line so that he may have a consistent set up. As discussed above, the same is true if the markings 30 are replaced with apertures that pass all the way through the entire bottom portion 16, whereby the golfer may see the ground below. Thus, if the golfer were to see anything other than the ground below, such as grass, the golfer will know that his eye position is not above the aim line. The bottom mid-line 17 and mid-line 25 may also be used as an additional alignment aid for the golfer. The golfer may visually line up the mid-line 25 with the bottom mid-line 17 when viewed through the apertures 26*a*, 26*b*, 26*c*. If the mid-line 25 and bottom mid-line 17 do not form a single visible line, the golfer will know he or she is not lined up correctly with the golf ball. In addition, the mid-line 25 may aid the golfer in lining up the center of the golf ball with the putter. When the mid-line 25 is located in the approximate center of the golf ball, the golfer will know that he or she is hitting the ball in the club's 10 approximate sweet spot.

FIGS. 1-4 also illustrate another alignment feature. The substantially parallel white lines 22, 24 may be spaced at a distance apart that is approximately the width of a golf ball. As the golfer prepares to putt, he or she may place the club 10 near the golf ball to align the putter 10 with the golf ball so that the lines 22, 24 are aligned with the edges of the ball. These lines 22, 24 may also be visible when an insert 40, 50 is used with the putter 10 to further aid in alignment.

As an alternative embodiment, the putter 10 allows for different interchangeable and removable inserts 40, 50 to be used. It is to be understood that a wide variety of inserts may be used with the putter and the inserts 40, 50 described herein are for illustrative purposes only. As can be seen in FIGS. 5-12, each of the inserts 40, 50 may be placed into the top portion 20 of the putter 10 by hand. One of the inserts may be a laser insert 40 that may include a laser 38 or any other appropriate lighting means.

The laser insert 40 may include a laser 38, a body 42, at least one marking 44, at least one column 46, and at least one protrusion 48. The body 42 may be of an approximately rectangular shape, but may also be of any other appropriate shape. The body 42 may have a front side 32, a top side 34 and a bottom side 36. The front side 32 may include an opening 33 where the laser beam 38 may shine out through. The top side 34 may have at least one marking 44. The top side 34 may also have a mid-line 35. The mid-line 35 may be located on the top side 34 of the body 42 and extend from one end to the other of the body 42. The mid-line 35 may be located in the approximate center of the body 42 and may extend through the center of each marking 44*a*, 44*b*, 44*c*. The mid-line 35 may also be substantially parallel each side of the body 42. The mid-line 35 may be of any appropriate or desired color, but is preferably white.

The markings 44 may be of any appropriate shape or size, but are preferably of a substantially circular shape and of a size that allows for three markings 44*a*, 44*b*, 44*c* to be used. The markings 44 may also be of any appropriate color, but are preferably of a white color. The bottom side 36 of the body 42 may include at least one column 46 extending there from that is positioned approximately perpendicular to the body 42. The columns 46 may be of any appropriate shape and size, but are preferably of a substantially circular shape and of a size that allows for three columns 46*a*, 46*b*, 46*c* to extend away from the body 42. Each column 46 may also include a protrusion 48 extending outward from and entirely around the column 46. There is preferably one protrusion 48*a*, 48*b*, 48*c* for each corresponding column 46*a*, 46*b*, 46*c*. Each protrusion 46 may be located near the bottom side 36 of the body 42.

Figure 10:
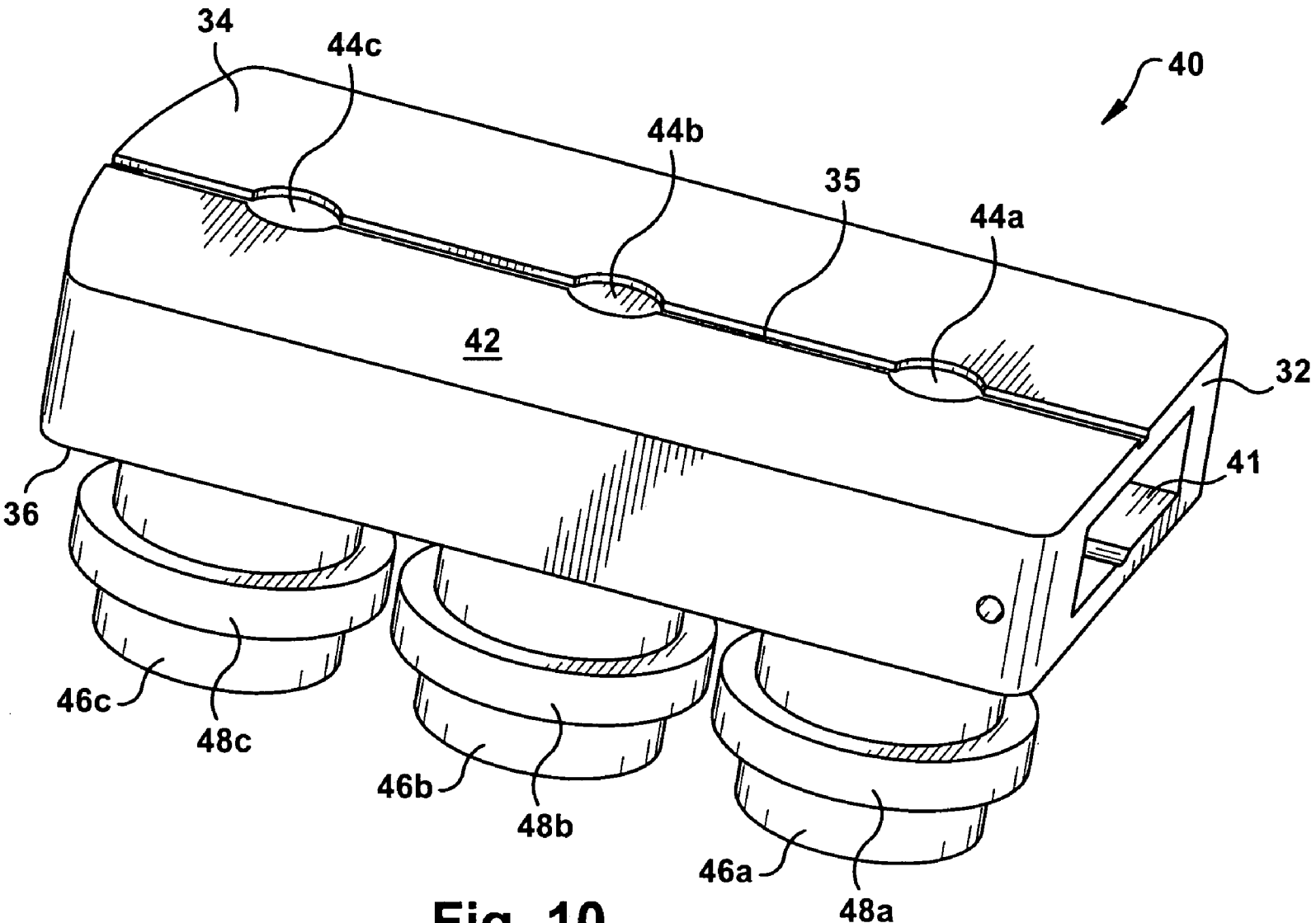
FIG. 10 illustrates a perspective view of a laser insert.
Figure 11:
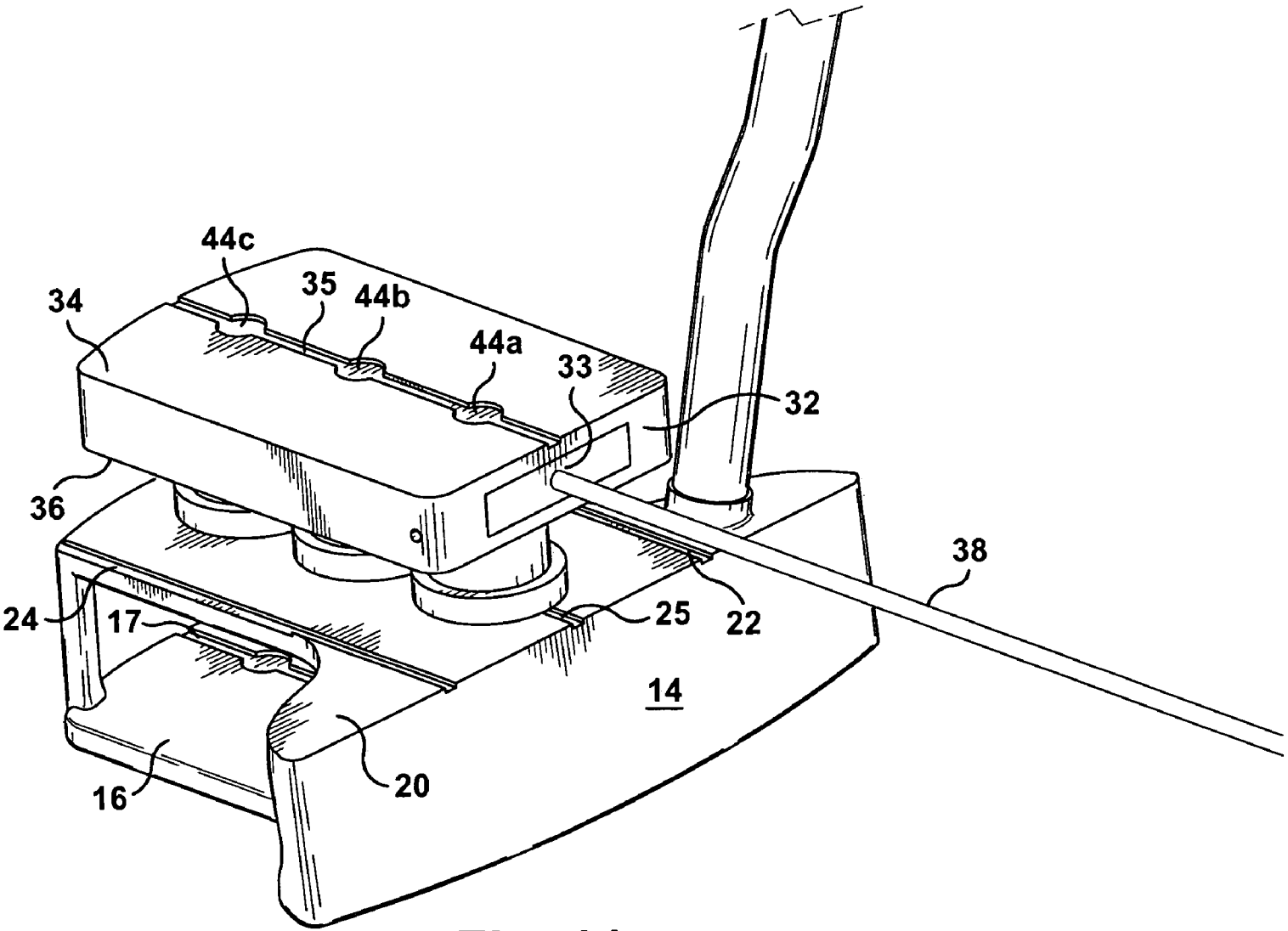
FIG. 11 illustrates a close up perspective view of an alternate embodiment of the golf club training device with the laser insert.
Figure 12:
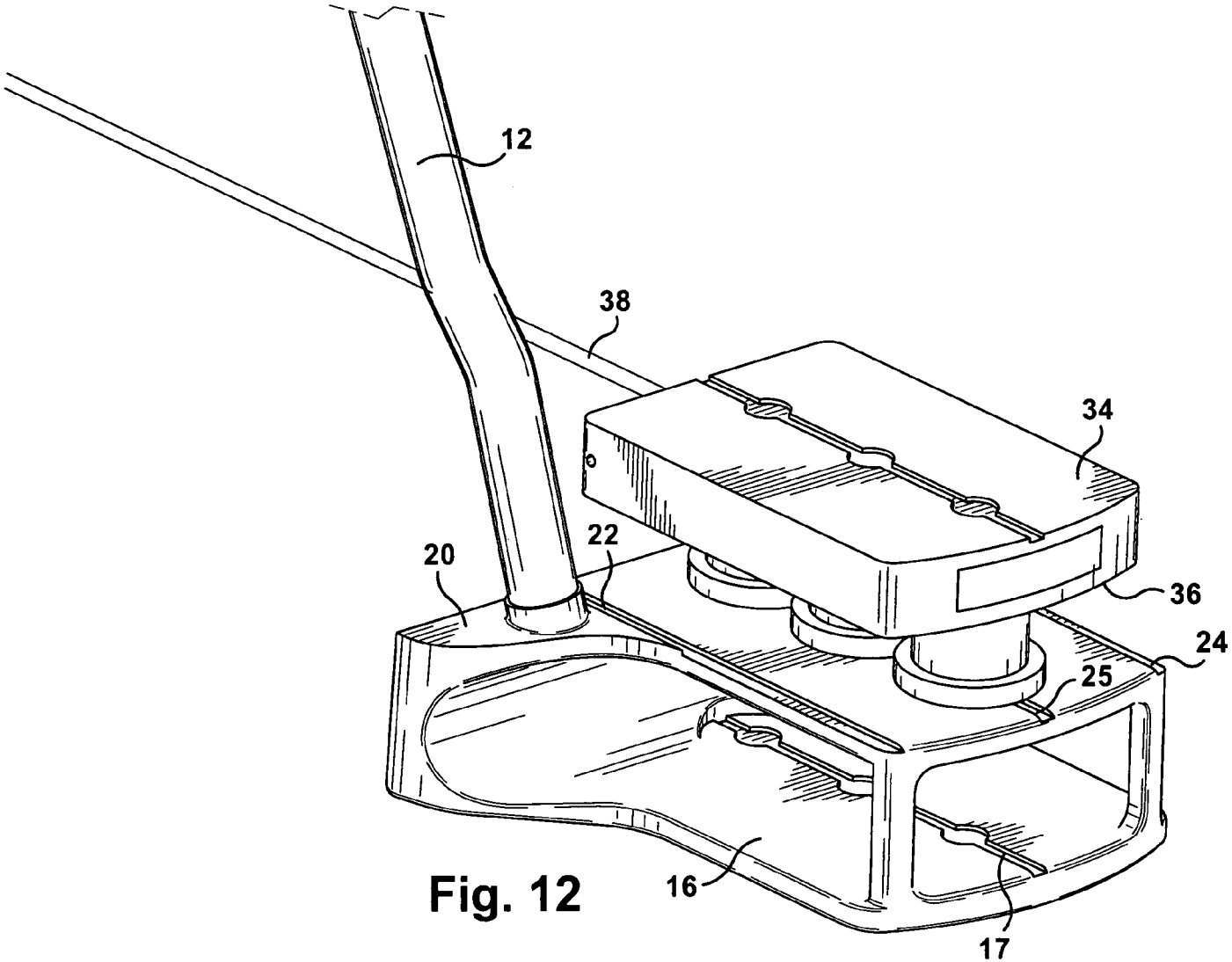
FIG. 12 illustrates another close up perspective view of the golf club training device with the laser insert.

With reference to FIGS. 10-12, the laser insert 40 may be positioned on top of and perpendicular to the clubface 14. As discussed above, the laser insert 40 has columns 46 to allow the golfer to align and place the laser insert 40 into the corresponding apertures 26 of the putter 10. The laser insert 40 allows the golfer to practice and get immediate feedback of exactly what he or she is aiming the clubface 14 at. The laser insert requires no calibration or adjustments. The insert 40 is easy to insert and remove so that the putter 10 can be used for USGA approved play. The laser insert 40 allows the golfer to practice hitting the "sweet spot" of the club 10. The laser 38 may be positioned to cast its image over the top of the golf ball to a specific target in the distance. The laser insert 40 allows the golfer to practice aiming and hitting the ball to a specific target. The laser 38 may be positioned so that it will casts its image onto the desired location where the golf ball is to be hit.

The laser insert 40 may be turned on by push button or any other appropriate means. The laser insert 40, when turned on may cast a beam or curtain onto the golf ball allowing the golfer to achieve perfect clubface 14 alignment to the target. Not only will the golfer use the laser insert 40 for clubface 14 alignment, but the golfer will also be able to align his body (feet, shoulders, etc) perpendicular to the beam to achieve proper body alignment. When the golfer is ready to putt, the golfer will address the golf ball by aligning the laser insert 40 to the target. The golfer will then align his body perpendicular to the laser lines and putt the ball.

Figure 5:
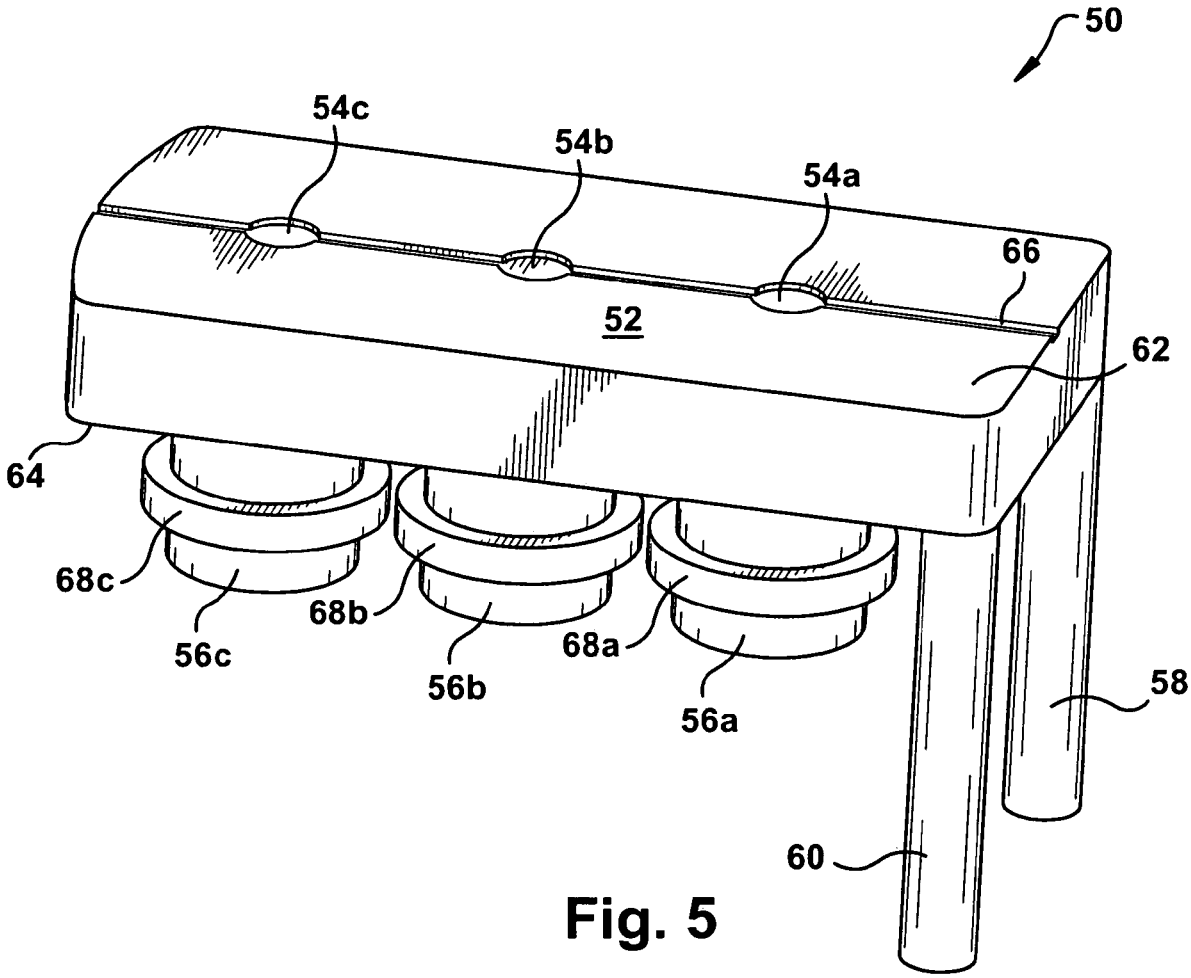
FIG. 5 illustrates a perspective view of a hanging post insert.
Figure 6:
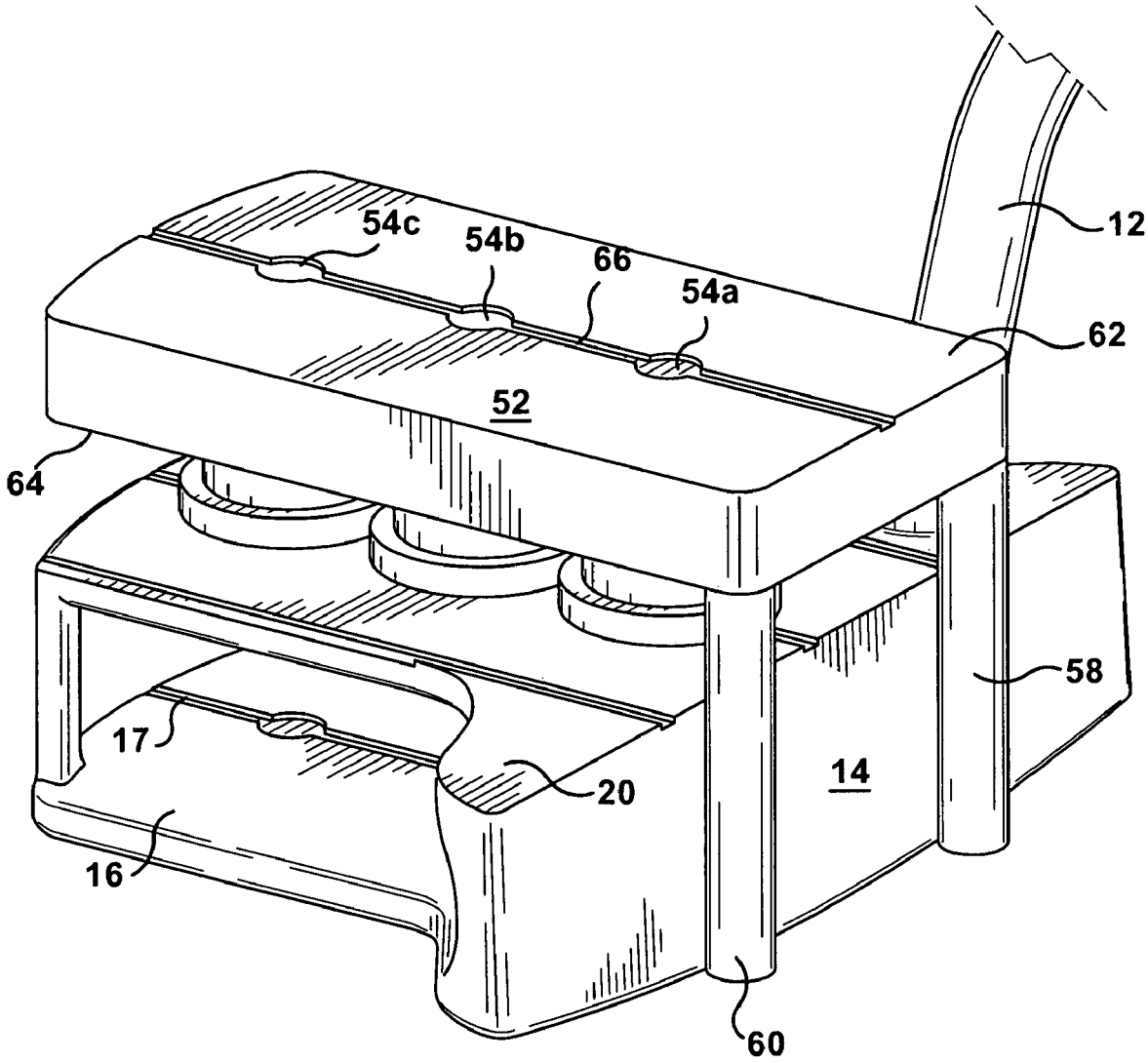
FIG. 6 illustrates a close up perspective view of an alternate embodiment of the golf club training device with the hanging post insert.
Figure 7:
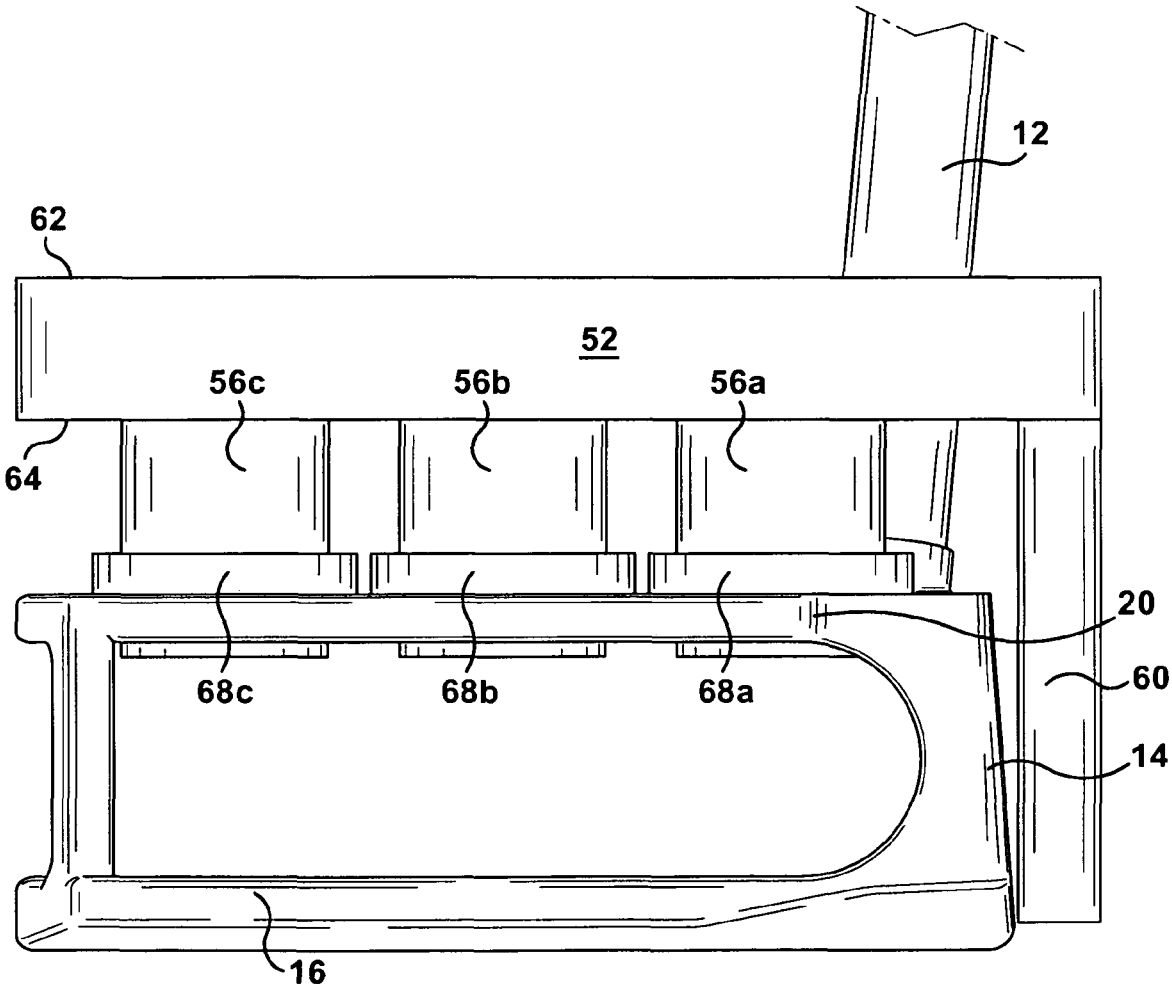
FIG. 7 illustrates a close up side view of the golf club training device with the hanging post insert.
Figure 8:
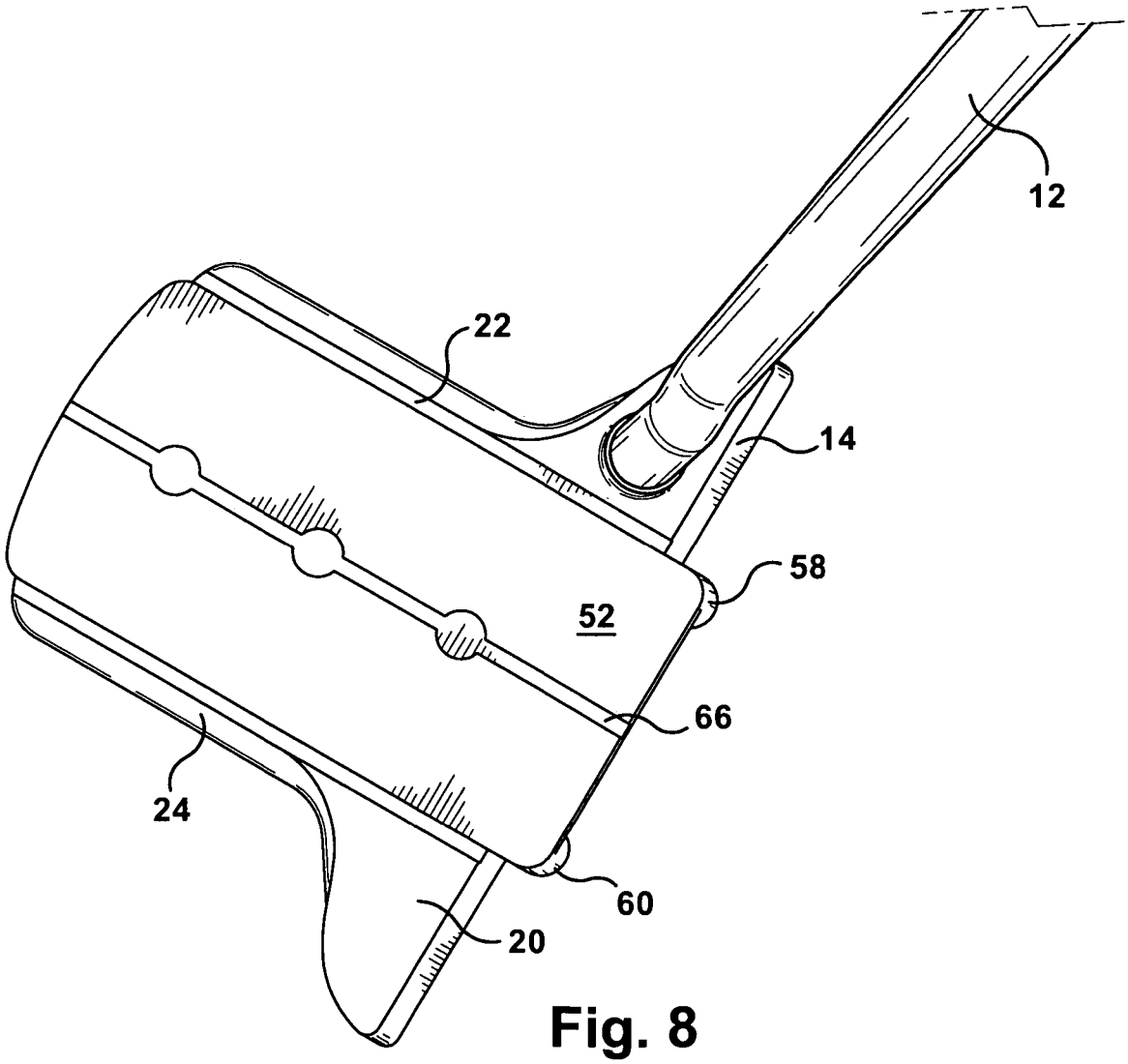
FIG. 8 illustrates a close up top view of the golf club training device with the hanging post insert.
Figure 9:
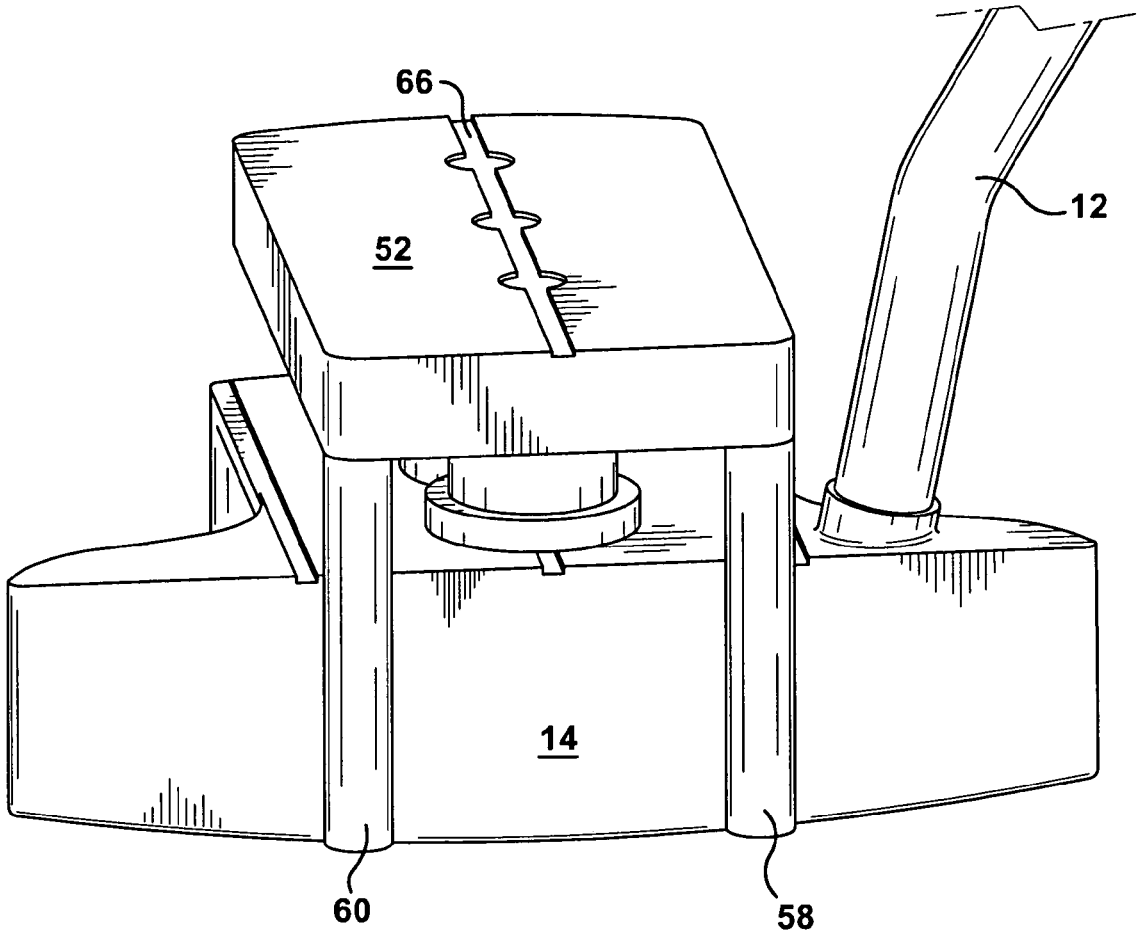
FIG. 9 illustrates a close up perspective view of the golf club training device with the hanging post insert.

Once the golfer can aim correctly from using the laser insert 40, the golfer may use the hanging post insert 50 to "groove" his putting stroke and produce on center hits. As seen in FIG. 5, the post insert 50 may include a body 52, at least one column 56, at least one marking 54, a first post 58 and a second post 60. The body 52 may be of an approximately rectangular shape, but may also be of any other appropriate shape. The body 52 may have a top side 62 and a bottom side 64. The top side 62 may have at least one marking 54. The markings 54 may be of any appropriate shape or size, but are preferably of a substantially circular shape and of a size that allows for three markings 54*a*, 54*b*, 54*c* to be used. The markings 54 may also be of any appropriate color, but are preferably of a white color. The top side 62 may also have a mid-line 66. The mid-line 66 may be located on the top side 62 of the body 52 and extend from one end to the other of the body 52. The mid-line 66 may be located in the approximate center of the body 52 and may extend through the center of each marking 54*a*, 54*b*, 54*c*. The mid-line 66 may also be substantially parallel each side of the body 52. The mid-line 66 may be of any appropriate or desired color, but is preferably white.

The bottom side 64 of the body 52 may include at least one column 56 extending therefrom that is positioned approximately perpendicular to the body 52. The columns 56 may be of any appropriate shape and size, but are preferably of a substantially circular shape and of a size that allows for three columns 56*a*, 56*b*, 56*c* to extend away from the body 52. Each column 56 may also include a protrusion 68 extending outward from and entirely around the column 56. There is preferably one protrusion 68*a*, 68*b*, 68*c* for each corresponding column 56*a*, 56*b*, 56*c*. Each protrusion 68 may be located near the bottom side 64 of the body 52.

The first and second posts 58, 60 may also be substantially perpendicular to the body 52 and extend away from the bottom side 64 of the body 52. The posts 58, 60 may be of any appropriate shape, such as round for example, and size. The posts 58, 60 may be located towards an end of the body 52 between an end and the first column 56*a*. The posts 58, 60 may also be located at an approximate width of slightly wider than a typical golf ball diameter so that the posts 58, 60 will only make contact with a golf ball if the golfer misses the sweet spot of the clubface 14.

When the columns 56*a*, 56*b*, 56*c* of the hanging post insert 50 are placed into the corresponding apertures 26*a*, 26*b*, 26*c* of the top portion 20, the posts 58, 60 will hangover and protrude from the clubface 14. If the golfer does not hit the sweet spot, the ball will strike one of the hanging posts 58, 60 giving immediate feedback of an off center hit. Impact on the sweet spot transfers maximum energy and eliminates rotation and wobble of the clubface 14. When the hanging post insert 50 is used, the golfer simply practices hitting putts on the sweet spot. This will allow for better feel, more confidence, maximum transfer of energy, and elimination of "twist" or "rotation" of the clubface caused by off center hits. Face angle errors at impact transfer eighty three percent (83%) to the ball line while the putter path has a minor seventeen percent (17%) influence on the starting line direction. This being said, aim and on center hits are arguably the two most important components of good putting.

The golfer also has the option to remove the laser insert 40 and the hangover post insert 50 for USGA approved play. As another alternative, the laser insert 40 may allow for the laser to be removed or slid out of the body 42 of the insert 40, as shown in FIG. 10. In this instance, a weighted insert (not shown) may alternately be inserted into the opening 41 and used with the golf club 10. The weighted insert would allow the golfer to simply add various amounts of additional weight to the putter 10. As a further alternative, the insert may be a combination of two or more inserts components or of all the insert components into one insert (not shown). In this instance, the insert may include hangover posts, a laser, and a weight, or some combination of these and additional elements known in the art. This permits the golfer to customize the weight and feel of the putter 10 to his preferred specifications.

The putter 10 allows the golfer to align the clubface 14 perfectly to the intended target line. Of all the putting fundamentals, the clubface 14 alignment of the putter 10 is the most important. The largest contributor to missed putts is a putter face 14 not aligned squarely at impact to the intended line. Without proper aim, a golfer can never learn a consistent putting stroke. The putter 10 will also allow the golfer to achieve more perfect body alignment and proper technique. The key to learning is immediate, accurate, and reliable feedback. This putter offers that. This training aid 10 gives a golfer a perfect aim and immediate feedback. It is an aid for a more perfect setup. These fundamentals allow for a confident putting stroke. Most training aids change the look, feel, and functionality of the golf club. This putter 10 may be used as a training aid and may also be used on the course.

The embodiments of the invention have been described above and, obviously, modifications and alternations will occur to others upon reading and understanding this specification. The claims as follows are intended to include all modifications and alterations insofar as they come within the scope of the claims or the equivalent thereof.

Having thus described the invention, we claim:

1. A golf club having an internal and external alignment device, the golf club comprising:

a handle having a grip at a first end and a head at a second end;

the head having an internal alignment device, said head comprising:

a contact plate;

a top plate extending rearwardly from said contact plate, wherein said top plate has a first upper surface;

a top alignment marking located along said first upper surface;

a bottom plate extending rearwardly from said contact plate and located beneath said top plate, wherein said bottom plate has a second upper surface;

a bottom alignment marking comprising a geometric shape and located along said second upper surface;

wherein said top plate includes at least one attachment aperture comprising a shape similar to that of said bottom alignment marking; and an external alignment device capable of engaging said at least one attachment aperture.

2. The golf club of claim 1, wherein said top plate and said bottom plate are parallel to one another.

3. The golf club of claim 1, wherein said shape of said bottom alignment marking is alignable with said at least one attachment aperture when said bottom alignment marking is located equidistantly within said at least one attachment aperture as viewed through said at least one attachment aperture.

4. The golf club of claim 1, wherein said first upper surface includes a first line and a second line, wherein said first line and said second line are parallel to one another.

5. The golf club of claim 4, wherein said first line and said second line are located approximately a golf ball width apart.

6. The golf club of claim 1, wherein said top alignment marking is a top alignment groove.

7. The golf club of claim 6, and said bottom alignment marking is a bottom alignment groove.

8. The golf club of claim 7, wherein said top alignment groove is aligned with said bottom alignment groove when said top and bottom alignment grooves appears as a single groove as viewed through said at least one attachment aperture.

9. The golf club of claim 1, wherein said external alignment device includes at least one column capable of being placed within said at least one attachment aperture.

10. The golf club of claim 9, wherein said external alignment device includes at least one protrusion extending around said at least one column.

11. The golf club of claim 10, wherein said at least one protrusion is capable of resting on said first upper surface.

12. The golf club of claim 11, wherein said external alignment device includes an alignment guide.

13. The golf club of claim 12, wherein said alignment guide includes two posts that extend downward from said guide and hangover in front of said contact plate.

14. The golf club of claim 13, wherein said posts are located approximately a golf ball width apart.

15. The golf club of claim 11, wherein said external alignment device includes a light source.

16. The golf club of claim 15, wherein said light source is a laser that emits a laser beam.

17. The golf club of claim 16, wherein said laser beam capable of projecting a line of light.

18. The golf club of claim 11, wherein said external alignment device includes a weight.

19. The golf club of claim 18, wherein said external alignment device includes a laser and an alignment guide.

20. The golf club of claim 1, wherein said geometric shape is a circle.

* * * * *